US005549420A

United States Patent [19]

Nakayama

[11] Patent Number: 5,549,420

[45] Date of Patent: Aug. 27, 1996

[54] RETAINING WALL STRUCTURE AND METHOD OF CONSTRUCTING SAME

[76] Inventor: Norio Nakayama, 5024, Nishiueta-cho, Takamatsu-shi, Kagawa-ken, Japan

[21] Appl. No.: 421,785

[22] Filed: Apr. 14, 1995

[30] Foreign Application Priority Data

Apr. 22, 1994 [JP] Japan ..... 6-084747

[51] Int. Cl.[6] ..... E02D 29/02; E02B 3/06

[52] U.S. Cl. ..... 405/286

[58] Field of Search ..... 405/286, 287, 405/284

[56] References Cited

U.S. PATENT DOCUMENTS

| | | | |
|---|---|---|---|
| 770,844 | 9/1904 | Church | 405/286 |
| 905,771 | 12/1908 | Upson | 405/286 |
| 1,663,453 | 3/1928 | Coke-Hill | 405/286 |
| 2,039,260 | 4/1936 | Ravier | 405/287 |
| 3,282,056 | 11/1966 | Fisher | 405/286 |
| 4,231,680 | 11/1980 | Ijima | 405/286 X |

FOREIGN PATENT DOCUMENTS

| | | | |
|---|---|---|---|
| A2060707 | 6/1971 | France . | |
| A2570729 | 3/1986 | France . | |
| 107187 | 9/1965 | Norway | 405/286 |

*Primary Examiner*—Stephen J. Novosad
*Attorney, Agent, or Firm*—Lorusso & Loud

[57] ABSTRACT

A retaining wall functioning both as a gravity-type retaining wall and as a leaning-type retaining wall is constructed on a sloped cut earth surface for the prevention of landslide. The retaining wall includes a bottom surface defined by a horizontal portion of the cut earth surface and having a transverse length of $L_2$, a top surface opposite the bottom surface and having a transverse length of $L_1$ which is greater than $L_2$, an outside surface extending generally vertically between the top and bottom surfaces, and an inclined surface opposite the outside surface and defined by the cut earth surface. The retaining wall has the center of gravity at a position so that part of the weight of the wall is imposed upon the sloped portion of the cut earth surface.

10 Claims, 11 Drawing Sheets

RETAINING WALL STRUCTURE AND METHOD OF CONSTRUCTING SAME

BACKGROUND OF THE INVENTION

This invention relates to a retaining wall structure constructed on a sloped cut earth portion, such as of a made land or a mountain surface, for preventing landslide. The present invention is also directed to a method of constructing the retaining wall structure.

In making a road on a mountain surface, the surface is first cut to form a sloped cut earth portion and a retaining wall is then constructed on the cut earth portion to prevent the landslide. The conventional retaining walls include a leaning type wall, a gravity type wall and a cantilever type wall.

FIG. 8 illustrates a typical conventional leaning type retaining wall structure $Y_1$ in which a retaining wall 103 is constructed on a longitudinally extending cut earth portion 102 of a mountain surface 101 so as to lean against a sloped surface 122 of the cut earth portion 102. The retaining wall structure $Y_1$ is constructed as follows. The mountain surface 101 is first cut to form the cut earth portion 102 having a longitudinally extending horizontal flat surface portion 121 and the sloped surface portion 122 obliquely upwardly extending from one side of the horizontal portion 121. The horizontal portion 121 has a transverse length (width) $N_1$ which is greater than the width M of the road to be constructed. In order to minimize the amount of the cut earth while preventing the crumbling of the sloped earth wall 122, the inclination angle of the sloped wall is generally 5°–10° from vertical. Thus, in the formation of the cut earth portion 102, that part of the earth which is defined by the triangular cross-section $A_1B_1C_1$ is removed. After the horizontal portion 121 and the sloped portion 122 have been formed, the retaining wall 103 is constructed along the sloped portion 122 such that the center of gravity G of the retaining wall 103 as constructed is located on an extension of the bottom line QP (which is in consistent with the horizontal line $A_1B_1$ of the horizontal portion 121), i.e. a distance D from the corner P of the retaining wall 103. As a consequence, part of the weight of the retaining wall 103 is imposed on the sloped portion 122.

The structure $Y_1$ shown in FIG. 8 has a problem that it is necessary to remove a large amount of the earth from the mountain surface 101 in order to provide a sufficient width $N_1$ for forming the road. Thus, the earth cutting work requires great labor and long time. Further, since the thickness of the retaining wall is relatively small, the structure $Y_1$ fails to exhibit a high landslide preventing strength.

FIG. 9 depicts a typical conventional gravity type retaining wall structure $Y_2$ in which a heavy retaining wall 203 is constructed on a longitudinally extending cut earth portion 202 of a mountain surface 201. The retaining wall structure $Y_2$ is constructed as follows. The mountain surface 201 is first cut to form the cut earth portion 202 having a longitudinally extending horizontal flat surface portion 221 and the sloped surface portion 222 obliquely upwardly extending from the horizontal portion 221. The horizontal portion 221 has a transverse length (width) $N_2$ which is slightly smaller than the width M of the road to be constructed. Thus, in the formation of the cut earth portion 202, that part of the earth which is defined by the triangular cross-section $A_2B_2C_2$ is removed. The length $A_2B_2$ is equal to or greater than the width $N_2$. After the horizontal portion 221 and the sloped portion 222 have been formed, the retaining wall 203 is constructed on the horizontal portion 221 and the space between the retaining wall 203 and the sloped portion 222 is filled with a suitable filler E such as earth and sand. The road is then constructed on the upper surface of the retaining wall and the fill.

The structure $Y_2$ shown in FIG. 9 has a problem that it is necessary to remove a large amount of the earth from the mountain surface 201 in order to provide a sufficient width $N_2$ for supporting the retaining wall 203 thereon. Since the retaining wall 203 prevents the landslide by its own weight, it is necessary that the width $N_2$ of the bottom of the retaining wall 203 and, hence, the length $A_{2hd\ B2}$ as well, should be sufficiently large. Thus, similar to the structure $Y_1$, the earth cutting work requires great labor and long time.

FIG. 10 depicts a typical conventional cantilever type retaining wall structure $Y_3$, in which an L-shaped retaining wall 303 composed of a horizontal section 325 and a vertical section 326, integrated with each other into a unitary structure, is constructed on a longitudinally extending cut earth portion 302 of a mountain surface 301. The retaining wall structure $Y_3$ is constructed as follows. The mountain surface 301 is first cut to form the cut earth portion 302 having a longitudinally extending horizontal flat surface portion 321 and the sloped surface portion 322 obliquely upwardly extending from the horizontal portion 321. The horizontal portion 321 has a transverse length (width) $N_3$ which is slightly smaller than the width M of the road to be constructed. Thus, in the formation of the cut earth portion 302, that part of the earth which is defined by the triangular cross-section $A_3B_3C_3$ is removed. The length $A_3B_3$ is equal to or greater than the width $N_3$. After the horizontal portion 321 and the sloped portion 322 have been formed, the retaining wall 303 is constructed on the horizontal portion 321 and the space defined between the retaining wall 303 and the sloped portion 322 is filled with a suitable fill E such as earth and sand. The road is then constructed on the upper surface of the retaining wall and the fill.

FIG. 11 shows another conventional cantilever type retaining wall structure $Y_4$ which is the same as the structure $Y_3$ except that a T-shaped retaining wall 403 is substituted for the L shaped wall 303. Thus, the reference numerals and symbols 401–403, 422, 425, 426, $N_4$, $A_4$, $B_4$ and $C_4$ in FIG. 11 correspond to 301–303, 322, 325, 326, $N_3$, $A_3$, $B_3$ and $C_3$, respectively, in FIG. 10. Because of the presence of an extended portion 427 in the horizontal section of the wall 403, the structure $Y_4$ shows an improved earth retaining property as compared with the structure $Y_3$.

The structures $Y_3$ and $Y_4$ shown in FIGS. 10 and 11 have a problem that it is necessary to remove a large amount of the earth from the mountain surface in order to provide a sufficient width $N_3$ or $N_4$ for supporting the retaining wall 303 or 403 thereon. Thus, similar to the above-described known structures, the earth cutting work requires great labor and long time. Further, since the weight of the fill E is relatively small, the structures $Y_3$ and $Y_4$ fail to exhibit a high landslide preventing strength.

SUMMARY OF THE INVENTION

It is, therefore, an object of the present invention to provide a retaining wall structure constructed on a cut earth surface, which can minimize the amount of earth cut and removed to form the cut earth surface and which can satisfactorily withstand the earth pressure applied thereto.

In accordance with the present invention, there is provided a retaining wall structure constructed on a cut earth surface having a longitudinally extending horizontal portion and a sloped portion upwardly obliquely extending from one side of said horizontal portion, said structure comprising a bottom surface received on said horizontal portion and having a transverse length of $L_2$, a top surface opposite said bottom surface and having a transverse length of $L_1$ which is greater than $L_2$, an outside surface extending between said top and bottom surfaces, and an inclined surface opposite said outside surface and received on said sloped portion, said structure having such a weight as to serve as a gravity retaining wall, and said structure having a center of gravity at a position so that part of the weight of said structure is imposed upon said sloped portion.

In another aspect, the present invention provides a method of constructing a retaining wall on a sloped land surface, comprising cutting said sloped land to form a cut surface having a longitudinally extending horizontal portion and a sloped portion upwardly obliquely extending from one side of said horizontal portion, and forming a retaining wall on said cut surface so that said wall includes a bottom surface received on said horizontal portion and having a transverse length of $L_2$, a top surface opposite said bottom surface and having a transverse length of $L_1$ which is greater than $L_2$, an outside surface extending between said top and bottom surfaces, and an inclined surface opposite said outside surface and received on said sloped portion, and said wall has the center of gravity at a position so that part of the weight of said wall is imposed upon said sloped portion.

BRIEF DESCRIPTION OF THE DRAWINGS

Other objects, features and advantages of the present invention will become apparent from the detailed description of the invention which follows, when considered in light of the accompanying drawings, in which.

DETAILED DESCRIPTION OF THE PREFERRED EMBODIMENTS OF THE INVENTION

Figure 1:
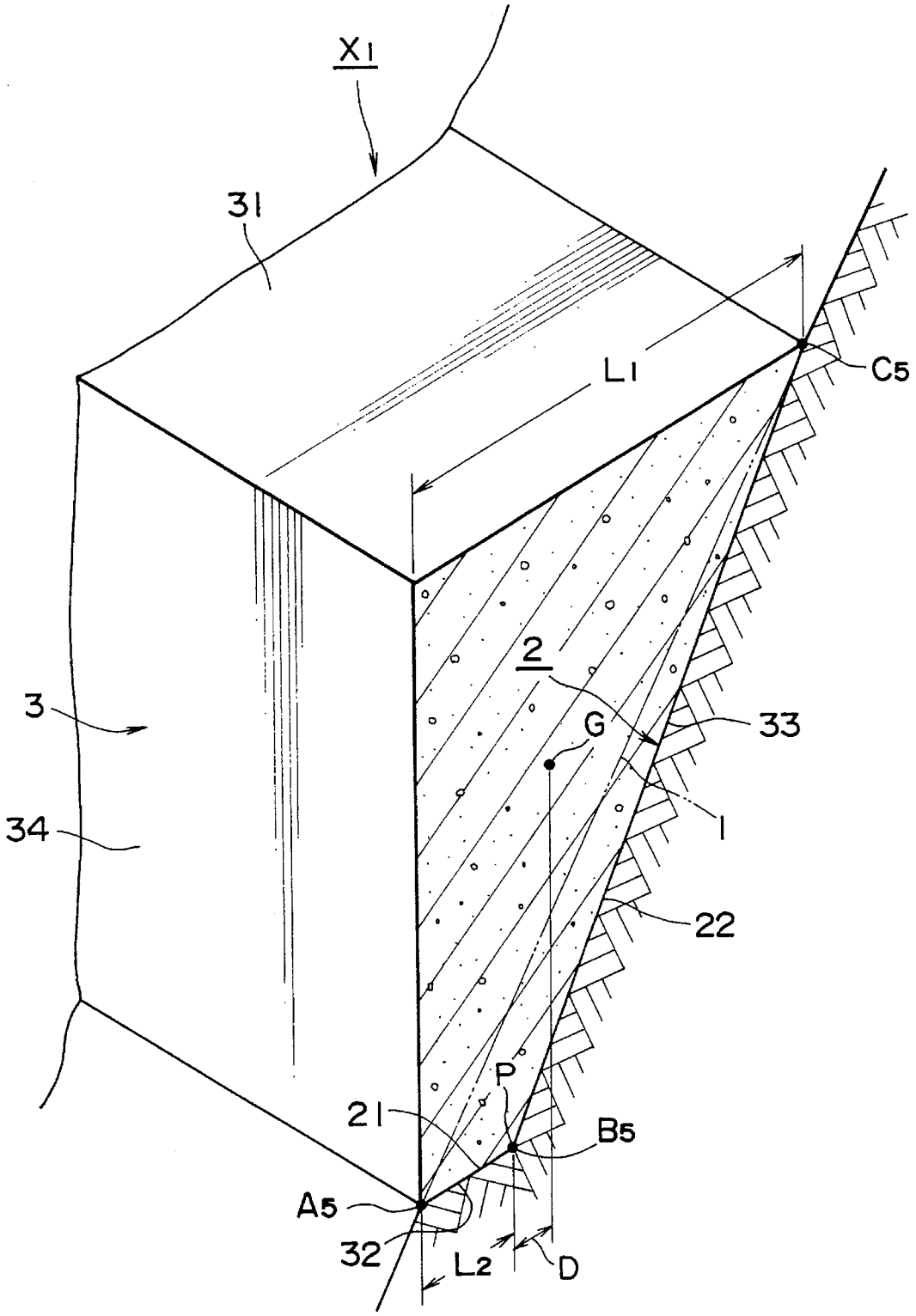
FIG. 1 is a fragmentary perspective view showing one embodiment of a retaining wall structure according to the present invention.
Figure 2:
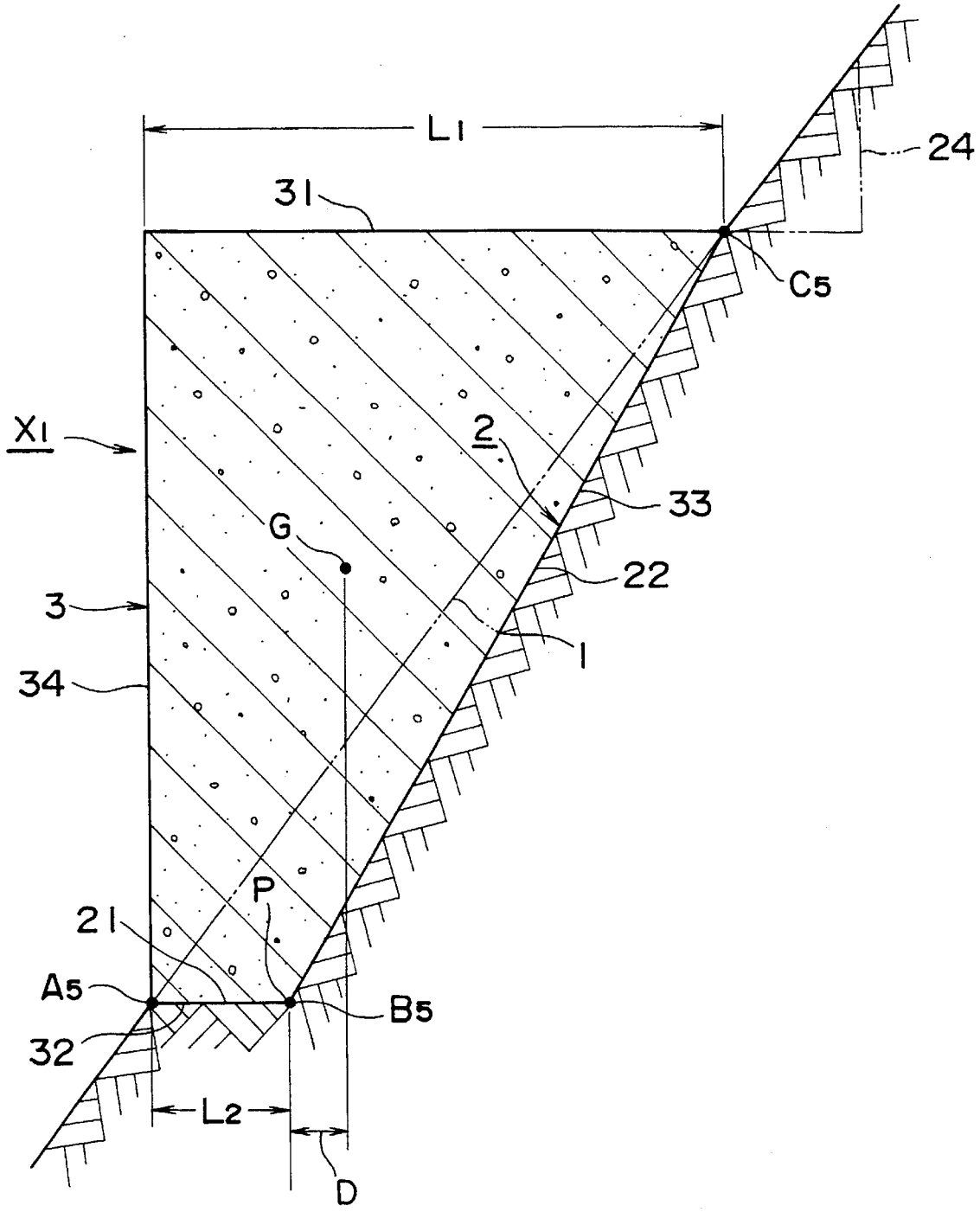
FIG. 2 is an elevational cross-sectional view of FIG. 1.

Referring now to FIGS. 1 and 2, designated generally as $X_1$ is a retaining wall structure constructed on a cut earth surface 2 formed on a sloped land surface 1 by cutting and removing the earth in a triangular portion $A_5B_5C_5$ from the sloped land 1. Thus, the cut earth surface has a longitudinally extending horizontal portion 21 having a transverse length (width) of $L_2$ and a sloped portion 22 upwardly obliquely extending from one side (corresponding to the point $B_5$) of the horizontal portion 21. It is preferred that the width $L_2$ of the horizontal portion 21 be as small as possible as long as the horizontal portion 21 can receive a retaining wall 3 thereon in a stable manner. When a road with a width of, for example, 3–8 m is to be constructed on the top of the retaining wall 3, then the width $L_2$ of horizontal portion 21 is preferably about 1–1.5 m. By reducing the width $L_2$, the area of the triangular portion $A_5B_5C_5$ becomes small so that the amount of the earth cut and removed from the sloped land surface 1 becomes small The retaining wall 3 of the structure $X_1$ in this embodiment is formed of concrete and has (a) a bottom surface 32 received on the horizontal portion 21 and having a transverse length equal to the width $L_2$ of the horizontal portion 21, (b) a top surface 31 opposite the bottom surface 32 and having a transverse length of $L_1$ which is greater than $L_2$ (for example, $L_1 \geqq 3L_2$ ), (c) an outside surface 34 extending between the top and bottom surfaces 31 and 32, and (d) an inclined surface 33 opposite the outside surface 34 and received on the sloped portion 22.

The outside surface 34 preferably has a vertical height H which is at least 5 times as great as the width $L_2$ of the horizontal portion 21. In the illustrated embodiment, the outside surface 34 is vertical. However, the outside surface 34 can be inwardly or outwardly inclined at an angle within the range of about ±30°, preferably about ±10° from the vertical plane.

Thus, the retaining wall 3 can serve to function as a gravity retaining wall. For example, when the retaining wall 3 is formed of concrete and has a bottom width $L_2$ of 1 m, a height H of 5 m, a top width $L_1$ of 3.5 m, then the weight of the retaining wall 3 is about 25 ton/m which is sufficient to serve as a gravity retaining wall.

As shown in FIG. 2, the center of gravity G of the retaining wall 3 is so positioned that part of the weight of the retaining wall 3 is imposed upon the sloped portion 22. More particularly, when the horizontal line passing through the points $A_5$ and $B_5$ (the point $B_5$ coincides with the corner P of the retaining wall 3) is regarded as being the X-axis, the X-axis component of the center of gravity G of the retaining wall 3 is located on an extension of the line $A_5B_5$, namely, at a position spaced a distance D from the point $B_5$ (P). As a consequence, the retaining wall 3 also functions as a leaning type retaining wall.

Thus, in the retaining wall structure $X_1$, the retaining wall 3 functions both as a gravity type retaining wall and a leaning type retaining wall, so that the retaining wall structure $X_1$ exhibits an excellent resistance to land slide. Further, since the retaining wall 3 has a small area in the bottom surface 32, the amount of earth removed from the sloped land 1 for the formation of the cut earth surface 2 can be minimized. It is preferred that $L_1$, $L_2$ and H of the retaining wall 3 have the following relationship:

$$7L_2 \geqq L_1 \geqq 3.5L_2 \text{ and } 10L_2 \geqq H \geqq 5L_2.$$

Figure 3:
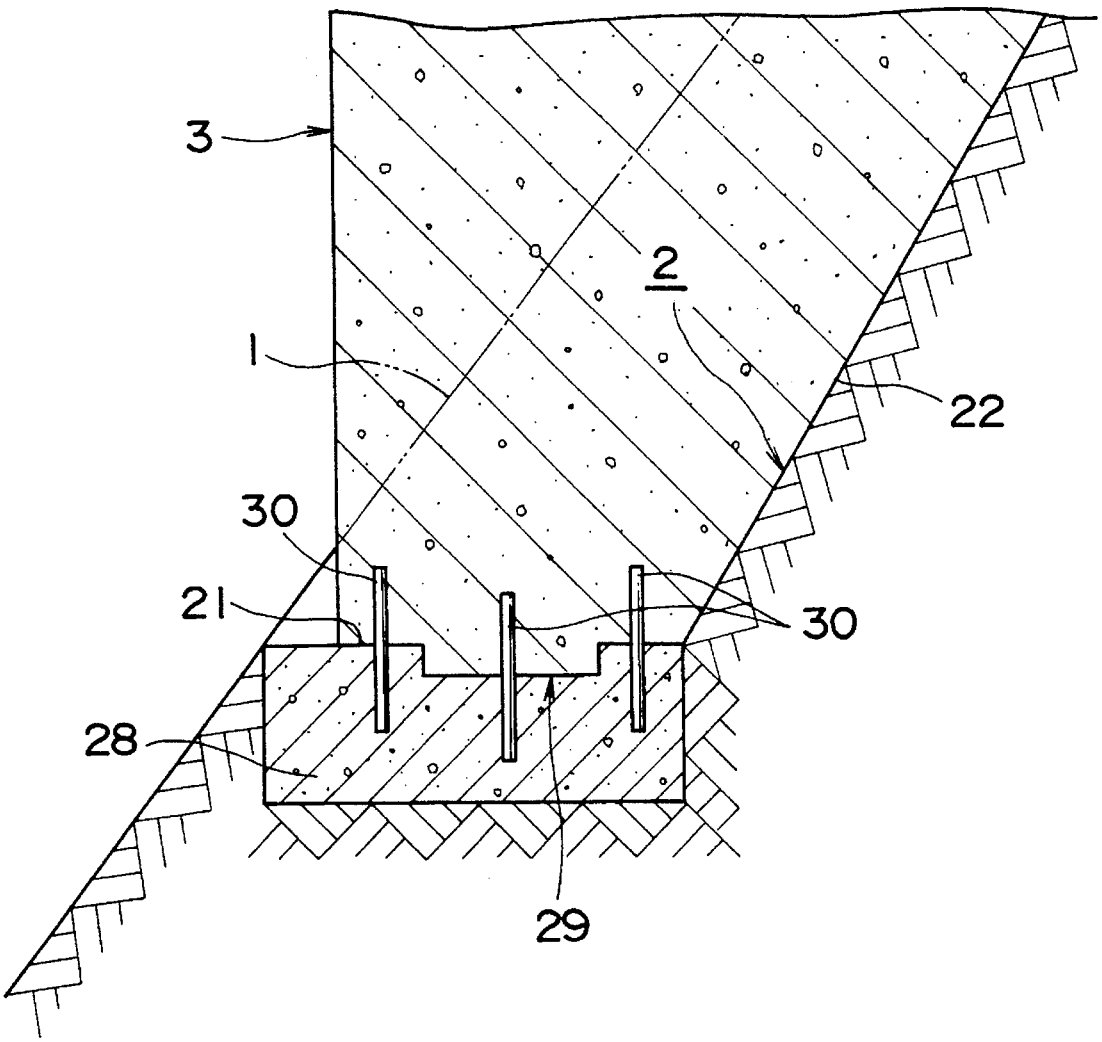
FIG. 3 is an enlarged, cross-sectional view, similar to FIG. 2, showing a modified structure.
Figure 4:
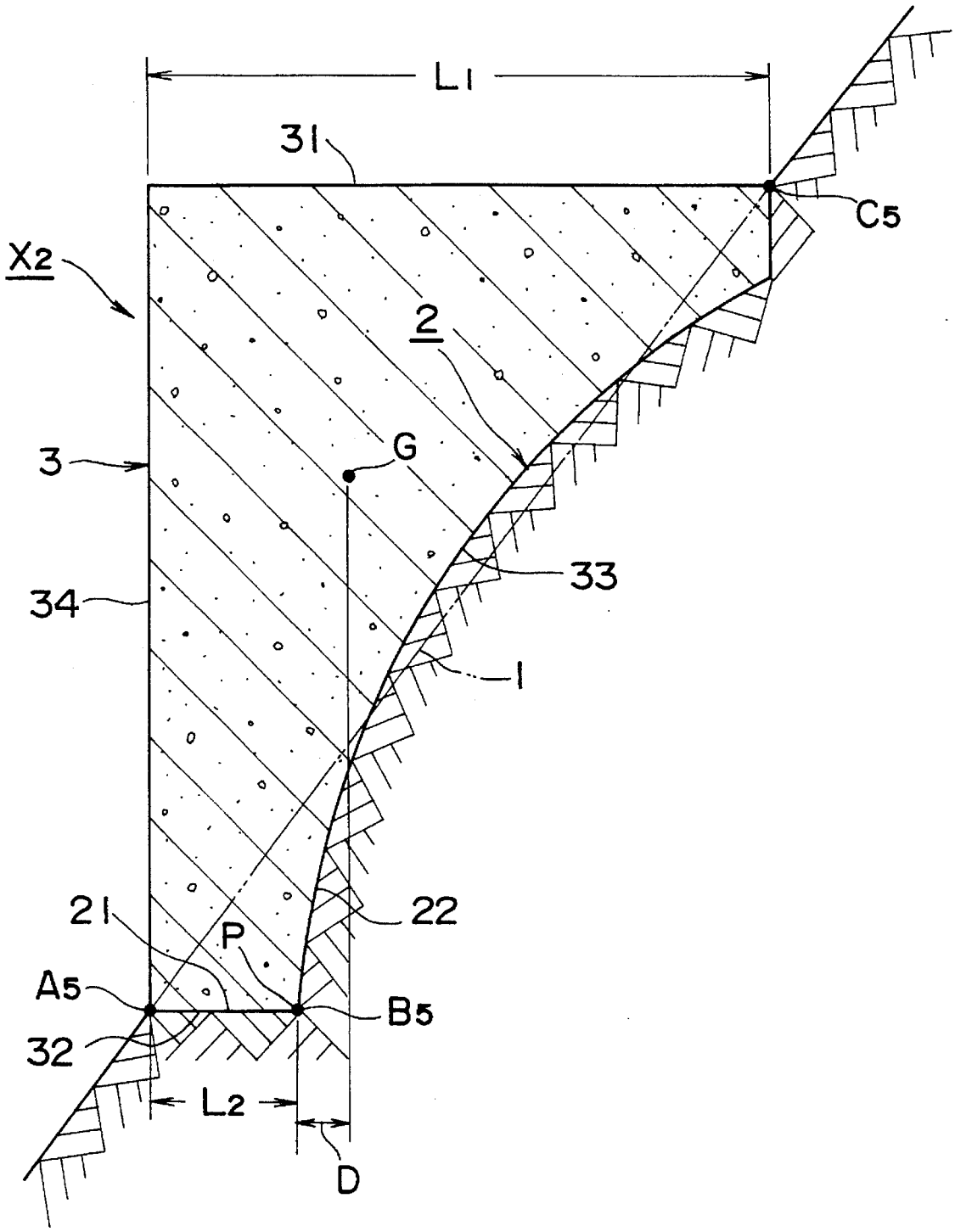
FIGS. 4–7 are elevational cross-sectional views, similar to FIG. 2, showing alternate embodiments of the present invention.

The structure $X_1$ can be modified in various manners as desired. For example, when the width $L_1$ is insufficient to construct a road with a desired width thereon, then, as shown in FIG. 2, a part 24 of the sloped land 1 may be removed to meet with the demand. When the base ground 21 is not hard, it is recommended to strengthen the foundation as shown in FIG. 3. In the embodiment shown in FIG. 3, the horizontal portion 21 of the cut earth surface 2 is strengthened by the formation of a concrete base 28. In this case, the foundation can be further improved by using iron reinforcements 30 joining the retaining wall 3 and the concrete base 28 and/or by forming a stepped portion 29 on the concrete base 28. The retaining wall structure $X_1$ can be also utilized for various land structures made for constructing thereon buildings, roads, railways, etc.

FIGS. 4–7 illustrates various modified structures, in which the same reference numerals designate similar component parts. In the retaining wall structure $X_2$ shown in FIG. 4, the sloped portion 22 of the cut earth surface 2 is outwardly curved and enlarged. The inclined surface 33 of the retaining wall 3 is inwardly curved to match the enlarged sloped portion 22. According to this embodiment, the amount of earth removed from the sloped land 1 is further minimized.

Figure 5:
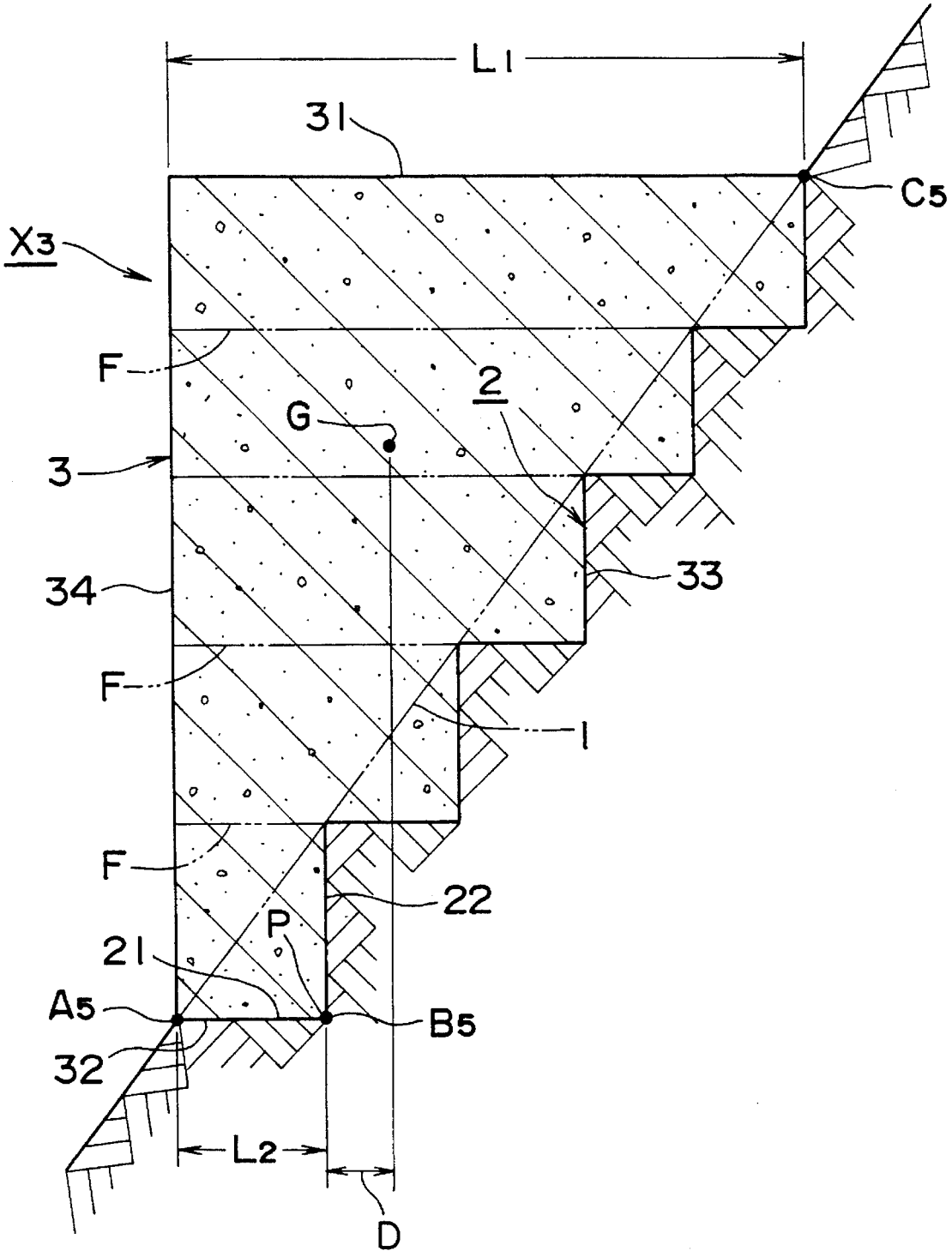

In the embodiment shown in FIG. 5, the sloped portion 22 of the cut earth surface 2 is shaped into tiers. The inclined surface 33 of the retaining wall 3 is stepped to conform to the tiered sloped portion 22. According to this embodiment, the amount of earth removed from the sloped land 1 is further minimized. In addition, the earth retaining effect of the structure $X_3$ is improved. In constructing the structure $X_3$, the retaining wall 3 may be constructed step by step as shown by the letter F.

Figure 6:
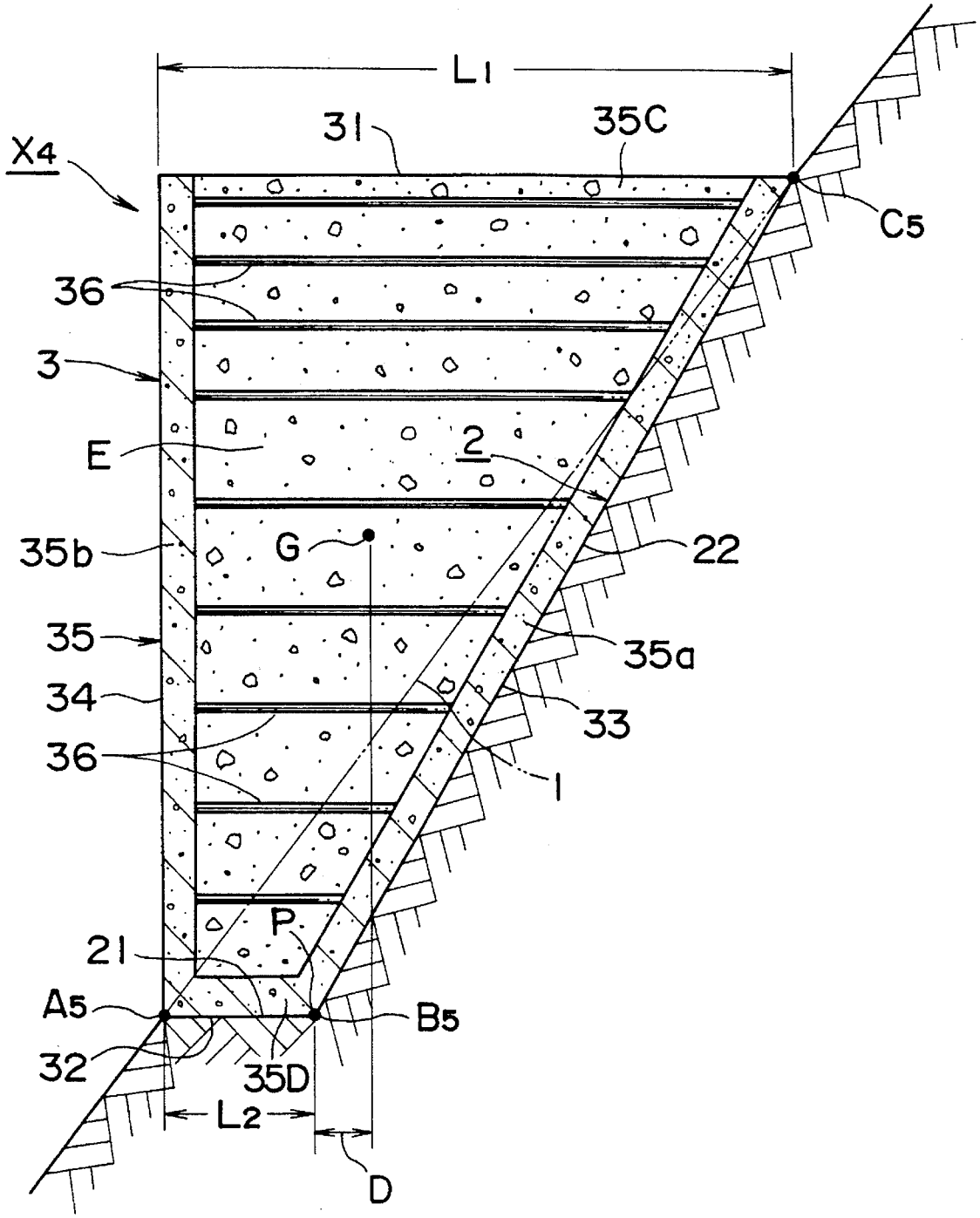

In the retaining wall structure $X_4$ shown in FIG. 6, the retaining wall 3 includes an outer shell 35 formed of concrete and having a bottom shell wall 35*d*, an outside shell wall 35*b*, a top shell wall 35*c* and an inclined shell wall 35*a*. A filling material E such as stone, earth and sand is packed within the shell 35. Reinforcements 36 such as steel frames may be disposed between the shell walls 35*a* and 35*b*. If desired, the top and bottom shell walls 35*c* and 35*d* can be omitted. The structure $X_4$ can be constructed with reduced costs. However, because of the reduced weight, the structure $X_4$ has a lower retaining effect in comparison with the structure $X_1$.

Figure 7:
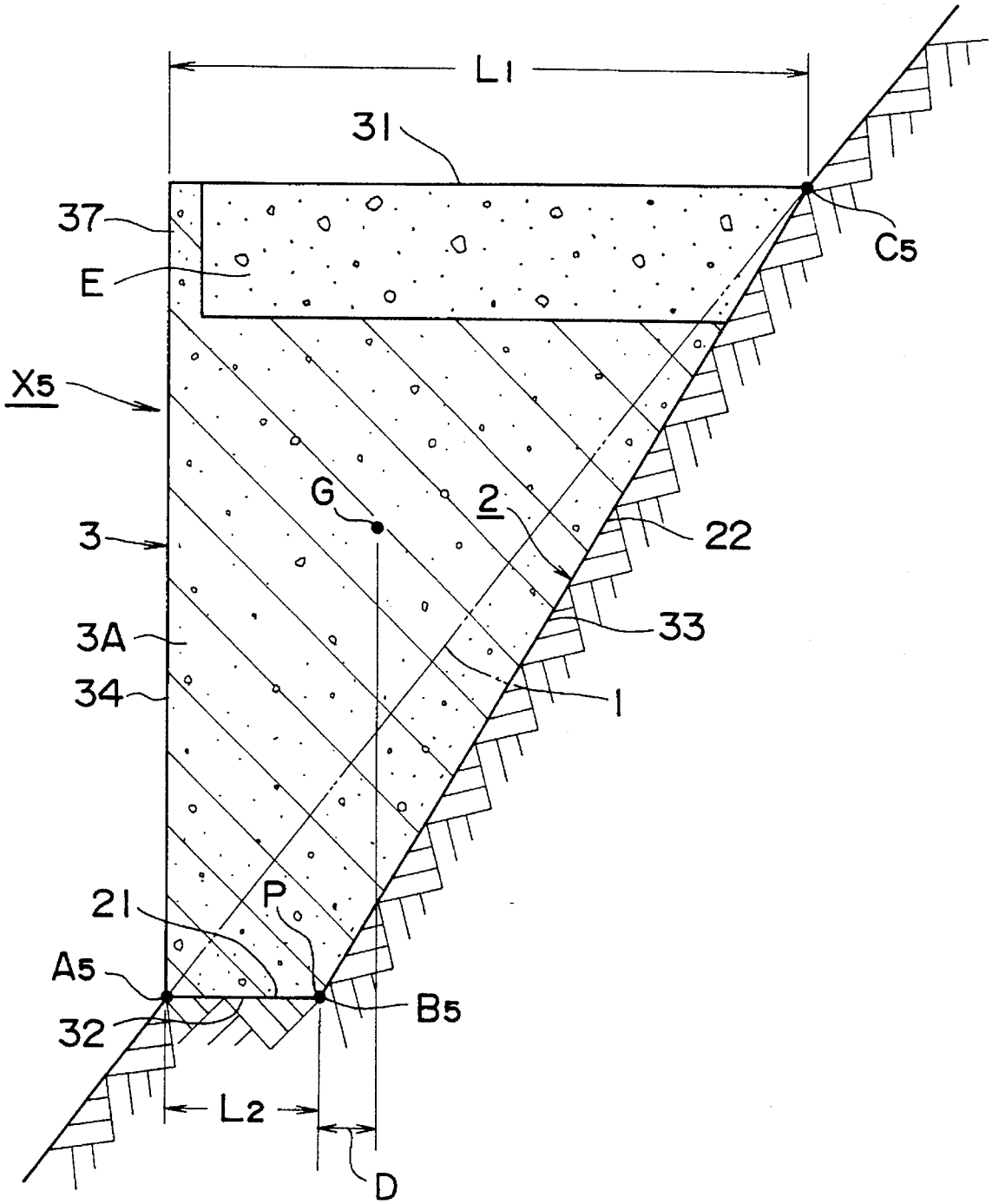
Figure 8:
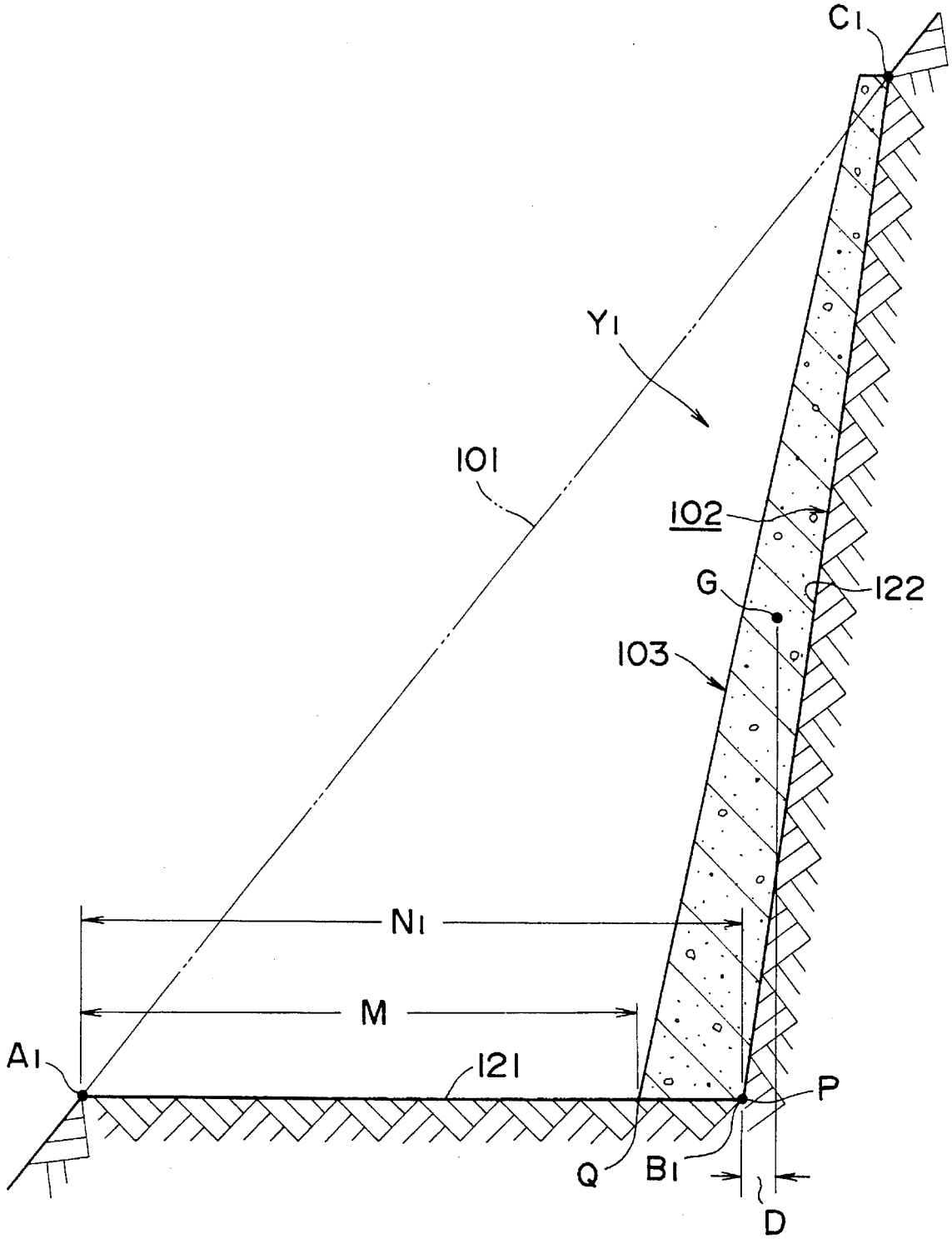
FIG. 8 PRIOR ART
FIGS. 8–11 are elevational cross-sectional views, similar to FIG. 2, showing conventional retaining wall structures.
Figure 9:
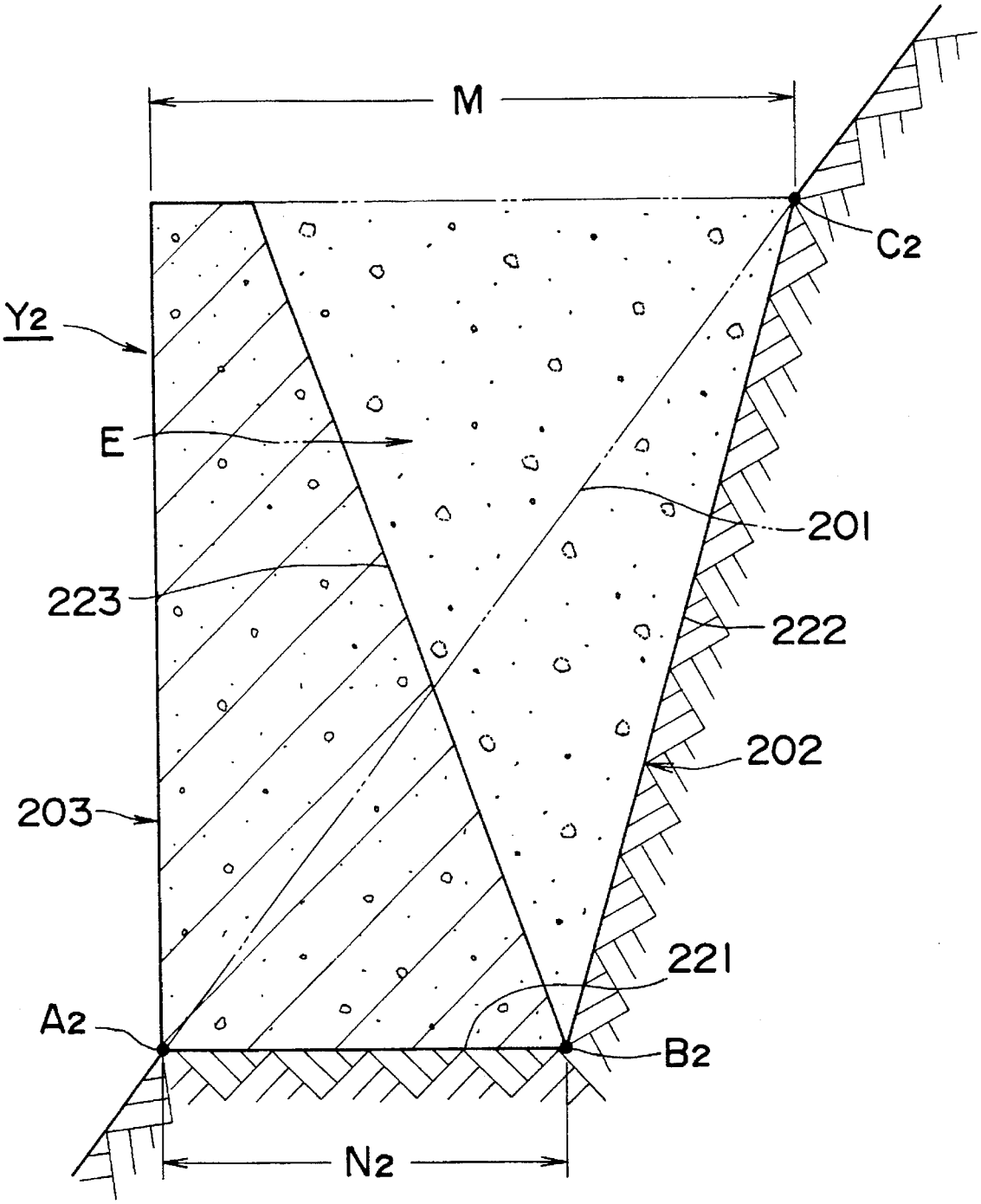
FIG. 9 PRIOR ART
Figure 10:
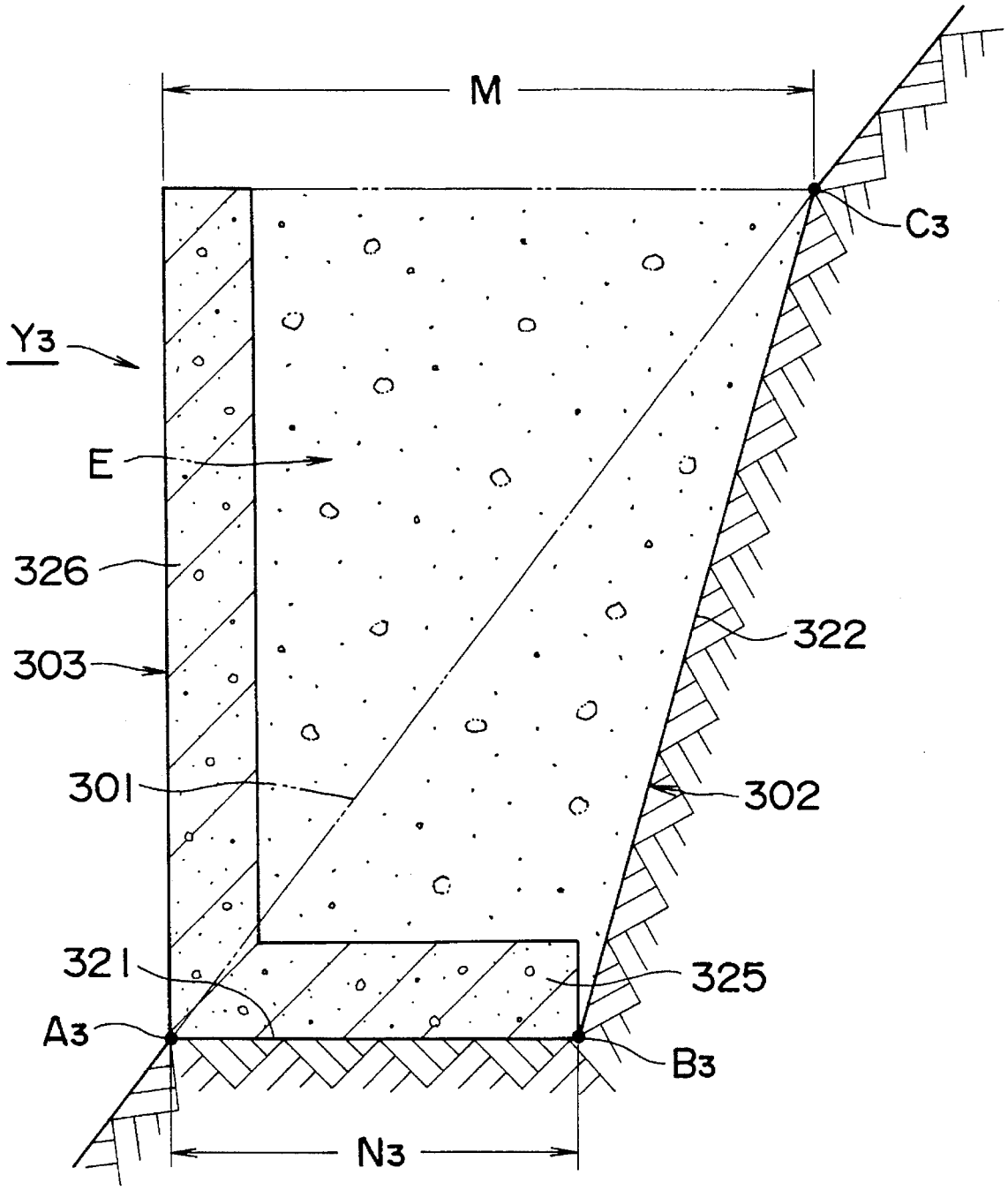
FIG. 10 PRIOR ART
Figure 11:
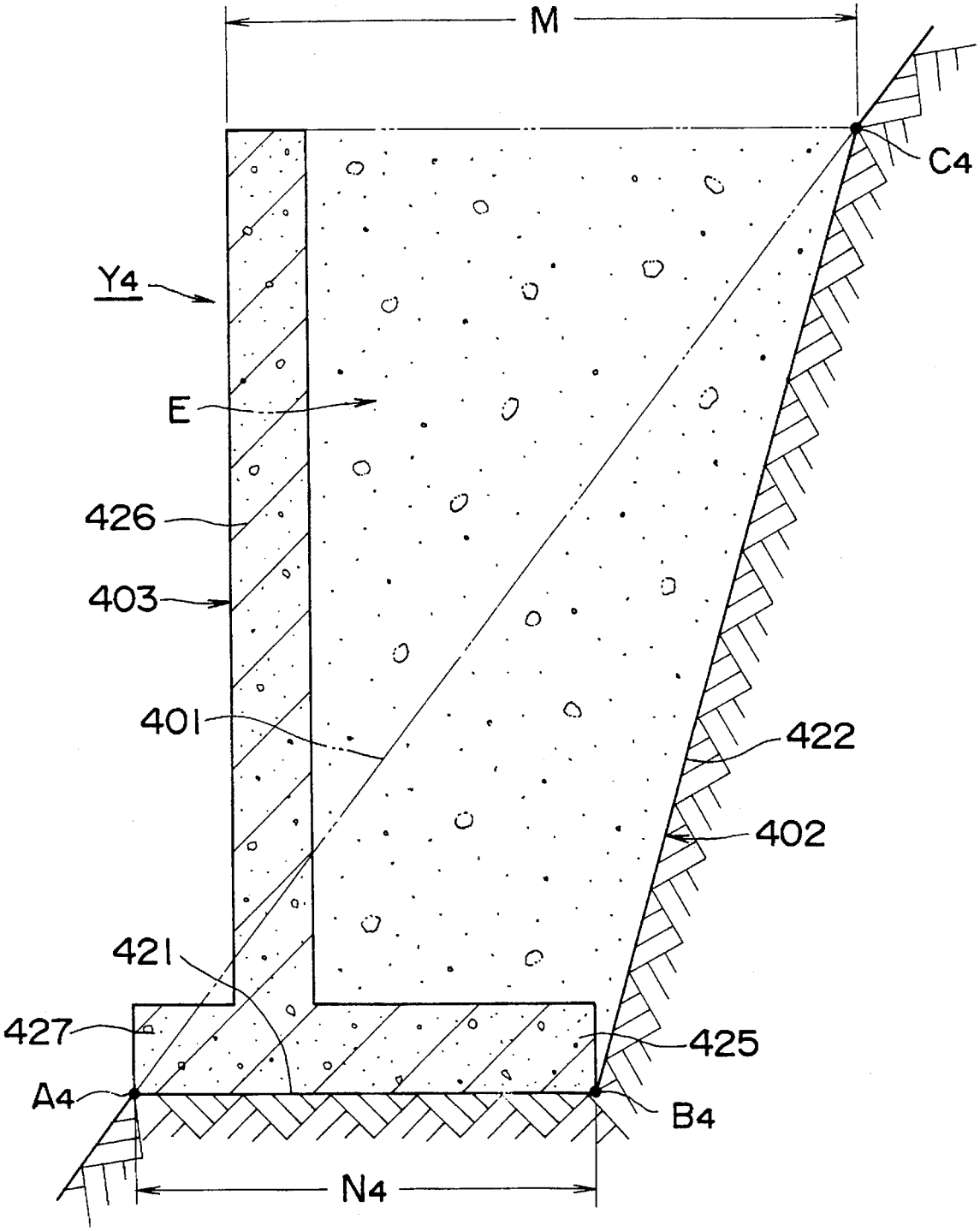
FIG. 11 PRIOR ART

In the retaining wall structure $X_5$ shown in FIG. 7, the retaining wall 3 is composed of a main body 3A and an integral dam wall 37 upwardly extending from the outside end thereof. The upper space defined above the main body 3A between the dam wall 37 and the inclined surface 22 is filled with a suitable material E such as stone, earth and sand. The structure $X_5$ can be constructed with reduced costs. However, because of the reduced weight, the structure $X_5$ has a lower retaining effect in comparison with the structure $X_1$.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

I claim:

1. A retaining wall structure constructed on a cut earth surface having a longitudinally extending horizontal portion and a sloped portion extending obliquely upward from one side of said horizontal portion, said structure comprising a bottom surface received on said horizontal portion and having a transverse length of $L_2$, a top surface opposite said bottom surface and having a transverse length of $L_1$ which is greater than $L_2$, an outside surface extending a vertical distance H between said top and bottom surfaces, and an inclined surface opposite said outside surface and received on said sloped portion, wherein $L_1$, $L_2$ and H have the following relationship:

$$L_1 \geqq 3L_2 \text{ and}$$

$$H \geqq 5L_2$$

said structure having sufficient weight to serve as a gravity retaining wall, and said structure having a center of gravity at a position so that part of the weight of said structure is imposed upon said sloped portion.

2. A retaining wall structure as claimed in claim 1, wherein said outside surface has a vertical height of H and wherein $L_1$, $L_2$ and H have the following relationship:

$$L_1 \geqq 3L_2 \text{ and}$$

$$H \geqq 5L_2.$$

3. A retaining wall structure as claimed in claim 1, wherein $L_1$, $L_2$ and H have the following relationship:

$$7L_2 \geqq L_1 \geqq 3.5L_2 \text{ and}$$

$$10L_2 \geqq H \geqq 5L_2.$$

4. A retaining wall structure as claimed in claim 1 and formed of a concrete.

5. A retaining wall structure as claimed in claim 4, wherein said concrete is reinforced by steel reinforcements.

6. A retaining wall structure as claimed in claim 1, wherein said inclined surface is inwardly curved to conform to said sloped portion.

7. A retaining wall structure as claimed in claim 1, wherein said inclined surface is stepped to conform to said sloped portion which is in tiers.

8. A retaining wall structure as claimed in claim 1, and comprising an outer shell formed of concrete and providing said bottom, outside and inclined surfaces, and a filling material packed within said shell and having an upper surface serving as said top surface.

9. A retaining wall structure as claimed in claim 2, wherein $L_2$ is 1–1.5 m.

10. A method of constructing a retaining wall on sloped land, comprising cutting said sloped land to form a cut surface having a longitudinally extending horizontal portion and a sloped portion extending obliquely upward from one side of said horizontal portion, and forming a retaining wall on said cut surface so that said wall includes a bottom surface received on said horizontal portion and having a transverse length of $L_2$, a top surface opposite said bottom surface and having a transverse length of $L_1$ which is greater than $L_2$, an outside surface extending a vertical height H between said top and bottom surfaces, and an inclined surface opposite said outside surface and received on said sloped portion, wherein $L_1$, $L_2$ and H have the following relationship:

$$L_1 \geqq 3L_2 \text{ and}$$

$$H \geqq 5L_2$$

and said wall having a center of gravity at a position so that part of the weight of said wall is imposed upon said sloped portion.

* * * * *

UNITED STATES PATENT AND TRADEMARK OFFICE

CERTIFICATE OF CORRECTION

PATENT NO. : 5,549,420

DATED : August 27, 1996

INVENTOR(S) : NAKAYAMA

It is certified that error appears in the above-indentified patent and that said Letters Patent is hereby corrected as shown below:

Col. 2, line 11, "$A_{2hd\ B2}$" should read --$A_2B_2$--.

Signed and Sealed this

First Day of July, 1997

Bruce Lehman

*Attest:*

BRUCE LEHMAN

*Attesting Officer*

*Commissioner of Patents and Trademarks*